US009587925B2

(12) United States Patent
Garcia et al.

(10) Patent No.: US 9,587,925 B2
(45) Date of Patent: Mar. 7, 2017

(54) ROCK BLASTING METHOD AND SYSTEM FOR ADJUSTING A BLASTING PLAN IN REAL TIME

(71) Applicant: VALE S.A., Rio de Janeiro (BR)

(72) Inventors: Luis Guilherme Uzeda Garcia, Belo Horizonte (BR); Rodrigo Duque Araki, Belo Horizonte (BR)

(73) Assignee: VALE S.A., Rio de Janeiro (BR)

( * ) Notice: Subject to any disclaimer, the term of this patent is extended or adjusted under 35 U.S.C. 154(b) by 0 days.

(21) Appl. No.: 14/629,427

(22) Filed: Feb. 23, 2015

(65) Prior Publication Data

US 2015/0241191 A1 Aug. 27, 2015

Related U.S. Application Data

(60) Provisional application No. 61/943,195, filed on Feb. 21, 2014.

(51) Int. Cl.

| | |
|---|---|
| ***F42D 1/05*** | (2006.01) |
| ***F42D 1/04*** | (2006.01) |
| ***F42D 1/06*** | (2006.01) |
| ***F42D 3/04*** | (2006.01) |
| ***F42D 1/055*** | (2006.01) |

(52) U.S. Cl.
CPC ..... *F42D 1/042* (2013.01); *F42D 1/055* (2013.01); *F42D 1/06* (2013.01); *F42D 3/04* (2013.01)

(58) Field of Classification Search
CPC . F42D 1/042; F42D 1/055; F42D 1/06; F42D 1/05; F42D 3/04
See application file for complete search history.

(56) References Cited

U.S. PATENT DOCUMENTS

| | | | | |
|---|---|---|---|---|
| 5,214,236 A * | 5/1993 | Murphy | F42D 1/05 | 102/215 |
| 6,079,333 A * | 6/2000 | Manning | F42D 1/05 | 102/200 |
| 6,941,870 B2 * | 9/2005 | McClure | F42D 1/055 | 102/311 |
| 7,492,279 B2 * | 2/2009 | Uitto | E21B 44/00 | 166/250.01 |
| 7,975,613 B2 * | 7/2011 | Labuschagne | F42D 1/055 | 102/215 |
| 8,994,515 B2 * | 3/2015 | Guyon | F42D 1/055 | 102/215 |
| 2004/0225431 A1 * | 11/2004 | Aebi | F42D 1/055 | 701/110 |
| 2005/0263027 A1 * | 12/2005 | Johnston | F42D 3/04 | 102/200 |
| 2006/0027121 A1 * | 2/2006 | Koekemoer | F42D 1/05 | 102/301 |

(Continued)

FOREIGN PATENT DOCUMENTS

WO WO 01/59401 A1 8/2001

*Primary Examiner* — Michael David
(74) *Attorney, Agent, or Firm* — Arent Fox LLP

(57) ABSTRACT

A rock blasting method and a system of rock blasting sensors and charges which form a network for use in the mining industry. The method and the system being able to self-adjust in order to maximize the extraction of raw material from a rock mass while minimizing the costs of operation and diminishing the environmental impact of the mining process.

16 Claims, 4 Drawing Sheets

(56) References Cited

U.S. PATENT DOCUMENTS

| | | | | |
|---|---|---|---|---|
| 2006/0042495 | A1* | 3/2006 | Russell | F42D 1/05 102/217 |
| 2006/0262480 | A1* | 11/2006 | Stewart | F41A 17/066 361/251 |
| 2008/0041261 | A1* | 2/2008 | Hummel | F42D 1/05 102/262 |
| 2009/0145321 | A1* | 6/2009 | Russell | F42B 4/00 102/215 |
| 2009/0193993 | A1* | 8/2009 | Hummel | F42D 1/055 102/215 |
| 2010/0116165 | A1* | 5/2010 | Moore | F42D 3/04 102/311 |
| 2011/0090091 | A1* | 4/2011 | Lerche | E21B 41/0021 340/853.2 |
| 2012/0325463 | A1* | 12/2012 | Chatelet | E21B 43/1185 166/250.01 |
| 2013/0205888 | A1* | 8/2013 | Teowee | E21B 47/06 73/152.46 |

* cited by examiner

ROCK BLASTING METHOD AND SYSTEM FOR ADJUSTING A BLASTING PLAN IN REAL TIME

CROSS-REFERENCE TO RELATED APPLICATION(S)

This application claims the benefit of U.S. Provisional Application No. 61/943,195 filed on Feb. 21, 2014, the entirety of which is incorporated herein by reference.

FIELD

The present invention generally relates to explosive detonator systems and in certain example aspects to a self-adjusting detonation system.

BACKGROUND OF THE INVENTION

Rock blasting is one of the initial steps of the production process in the mining industry. The main objective of a rock blasting operation is to maximize the extraction of raw material while minimizing the costs and the environmental impact of the operation. In general, the operation of rock blasting is performed by the detonation of chemical explosives placed on or in tubular holes on a rock mass.

The rock blasting operation is performed according to a "blast plan" prepared under the supervision of engineers with experience in mine planning. The blast plan defines a set of controllable parameters, such as: diameter, spacing and depth of the explosive holes, load mass of the explosives, spatial distribution of the explosives and chronological sequencing of the explosions.

To optimize the rock blasting operation, the technique of sequential detonation is frequently used. This technique makes use of delay in the blasting activities, controlling the time lag between the firing of explosive charges. The nature of the shock waves resulting from the explosion, in association with the time interval between detonations, leads to interference patterns among the shock waves. These interferences can be used to benefit the mining process, providing higher quality to the rock blasting operation.

The appropriate chronological sequencing of the explosions minimizes unwanted vibrations, facilitates the fragmentation of the rocks, and is of great importance in underground mining operations.

Besides the chronological sequencing detonations, other controllable variables in the blast plan include: the diameter, spatial distribution, spacing and depth of the holes and the load mass of the explosives.

On the other hand, examples of uncontrollable variables of the blast plan are: the weather conditions and the ground geology.

It is known that the propagation of mechanical waves depends strongly on the geology of the land. Hence, a good blast plan has to consider the structure of the rock mass and its properties and also has to take into account its mechanical reaction to the blasts and other external conditions.

A blast plan that does not consider such uncontrollable variables can lead to poor fragmentation, may damage the adjacent walls of the quarry and may increase environmental impacts and operational costs.

Nevertheless, the exact determination of the geological conditions of a specific terrain is very difficult and expensive to ascertain and sometimes may even be unpractical, e.g. outer space mining. The samples of materials tested in a laboratory before the development of the blast plan exclude discontinuities and unforeseen lithological changes in the rock mass from which they came.

The prior art also includes several tools and techniques designed to improve the blast plan. These techniques (usually of empirical nature) include several formulas involving geometric patterns and may make use of old-fashioned tools such as abacus and slide rules. Anyhow, these methods often ignore a large number of variables that influence the quality of the rock blasting.

Another drawback of the blast plan of the prior art is that, once triggered, it cannot be corrected during the process of detonation. In case of unsatisfactory results, the development of a new blast plan is required. FIG. 1 illustrates a prior art operational process 100 of rock blasting.

In the prior art, the activation of the explosive charge is performed by means of an initiation system. The initiation system (also known as a "trigger") can be any of the following devices: a non-electrical trigger, an electrical trigger, an electronic trigger or a wireless trigger.

Among these four devices, the most popular in the mining industry are the electrical and electronic triggers. Both allow the timing control of the explosion, especially the electronic triggers, which have very precise timers and control means.

As for the non-electrical trigger and the wireless trigger, the former one has become obsolete and the latter one, until recently, was almost exclusive to military operations. Nowadays, the explosives industry is starting to take advantage of the ever decreasing sizes and costs of the wireless electronic devices available on the market. The wireless components available these days are so small and inexpensive that they might be considered expendable. The main benefits of the wireless sensor is the higher distance provided from the controllers to the explosives (which implies higher safety standards) and the possibility of abortion of the rock blasting operation at any given time. The prior art wireless sensors usually employ conventional bidirectional radio systems (VHF or UHF).

The prior art document WO/2001/059401 reveals a wireless detonation system that employs radio transmitters to activate a wide range of detonators placed near to explosive loads disposed inside of a rock mass. The technology of WO/2001/059401 comprises a main controller (a computer disposed near a blast operator employee) and a radio frequency base transmitter (disposed nearby the rock mass). The main controller coordinates the timing of explosions and delivers electronic signals to the RF Base Transmitter, which, in turn, sends radio commands to the detonators of the explosive loads spread across the rock mass.

One of the shortcomings of the technology disclosed in WO/2001/059401 is that the detonation system does not account for the discontinuities and unforeseen lithological changes in the rock mass that may lead to an inefficient blasting operation. Furthermore, conventional charges do not have embedded intelligence, communication and sensing capabilities.

BRIEF SUMMARY OF THE INVENTION

In certain example aspects, the invention is directed to a rock blasting method comprising: initiating a rock blasting operation via a processor based on a pre-established firing pattern; collecting real time data during the rock blasting operation via a plurality of sensors; and adjusting in real time the rock blasting operation according to execution of a blast plan adjustment algorithm and based on the collected real time data, wherein the adjusting includes at least one of anticipating, or delaying, or canceling the rock blasting operation of at least one explosive load.

In other example aspects the invention is directed to a rock blasting wireless sensor network, comprising: an initiation system arranged to detonate a plurality of explosive loads in a rock blasting operation; a plurality of rock blasting sensors arranged to detect rock blasting parameters during the rock blasting operation; a wireless communication device arranged to communicate with the rock blasting sensors to exchange data; a processor for decoding and processing the rock blasting parameters according to a blast plan adjustment algorithm to generate an adjustment signal; and wherein at least one of the rock blasting sensors is in communication with the processor, during the rock blasting operation, to receive the adjustment signal in real time, to adjust a blast timing of at least one of the plurality of explosive loads.

Additional advantages and novel features in accordance with aspects of the invention will be set forth in part in the description that follows, and in part will become more apparent to those skilled in the art upon examination of the following or upon learning by practice thereof.

Figure 1:
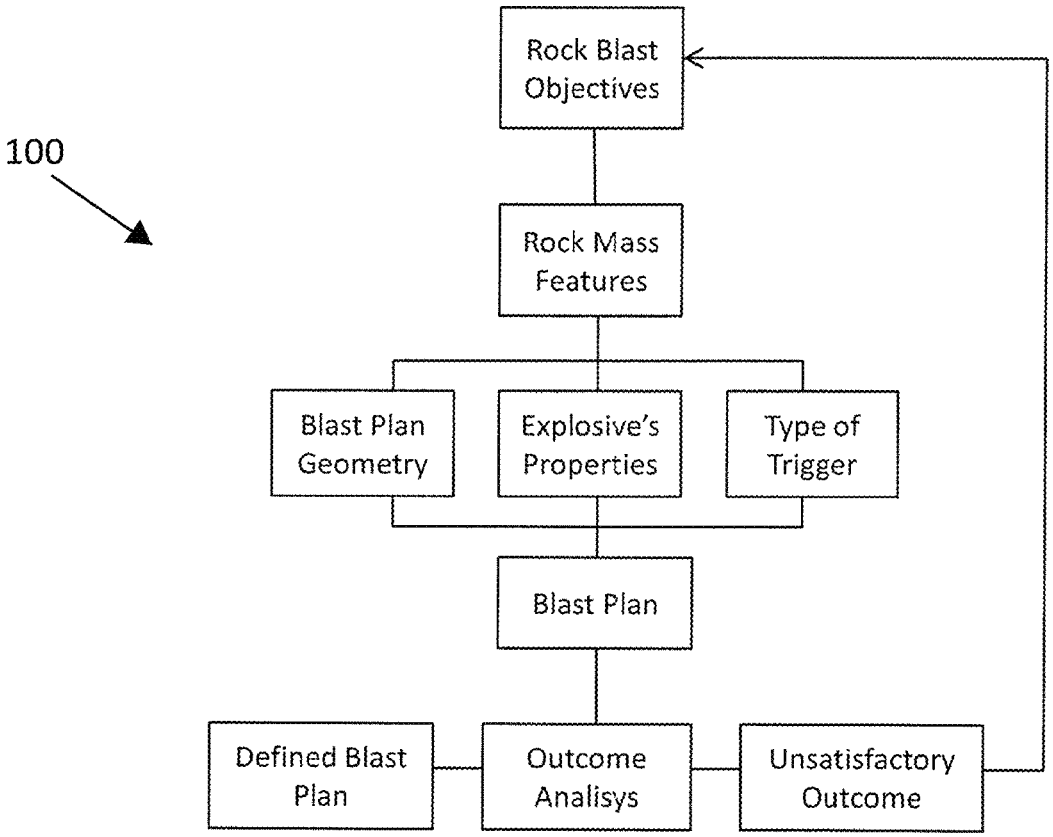
Fig. 1 (prior art)
FIG. 1 is a flowchart of a prior art rock blasting operation.

These and other features and advantages in accordance with aspects of this invention are described in, or are apparent from, the following detailed description of various example aspects.

DETAILED DESCRIPTION OF THE INVENTION

With reference to FIGS. 2-5, in various example aspects, the present invention is directed to the use of several interconnected rock blasting sensors 215, 315, 415, 515, also denoted as δi, where i may be a whole number, where each sensor may be connected to one or more blast loads (or explosive charges) 216, 416 (e.g., "smart loads"). The rock blasting sensors 215, 315, 415, 515 are configured to measure and collect blasting data and to allow real time information exchange between the sensors and/or one or more processors (or computers) 510 executing a blast plan adjustment modules 545 to adjust a blast plan in real time. The information may be transferred between the sensors 215, 315, 415, 515, δi and one or more processors (or computers) 510, by means of a modern wireless communication protocol, such as but not limited to a protocol developed specifically for machine-to-machine communication (M2M).

Such rock blasting sensors 215, 315, 415, 515, δi may be coupled to (e.g., directly attached to, wired, or wirelessly connected) the explosive loads (e.g., to form "smart charges") and positioned in, on or near the blast loads 216, 416 or the holes for the blast loads 216, and/or distributed on the ground surface of the rock mass. Each sensor 215, 315, 415, 515, δi may include one or more components, such as, a processor 510, a memory device 520, digital and/or analog transducers and/or other types of measuring devices 540 configured to collect, store and analyze a broad range of data during the course of the rock blasting operation. For example, each rock blasting sensor 215, 315, 415, 515, δi may include one or more of a pressure transducer, a thermocouple, a micro-pressure sensor, an interferometer-based sensor, a fiber optic sensor for measuring surface displacements, a piezo-electric shock wave pressure sensor, such as a quartz, ceramic or tourmaline shock wave sensor, a seismograph sensor, or a strain gauge (collectively 540). In certain example aspects, the data collected by each rock blasting sensor 215, 315, 415, 515, δi may include, but is not limited to: the speed of propagation of the shock waves, pressure, mechanical stress (e.g., tension, traction), and temperature, before and after the detonation of an explosive load in a given hole.

Figure 4:
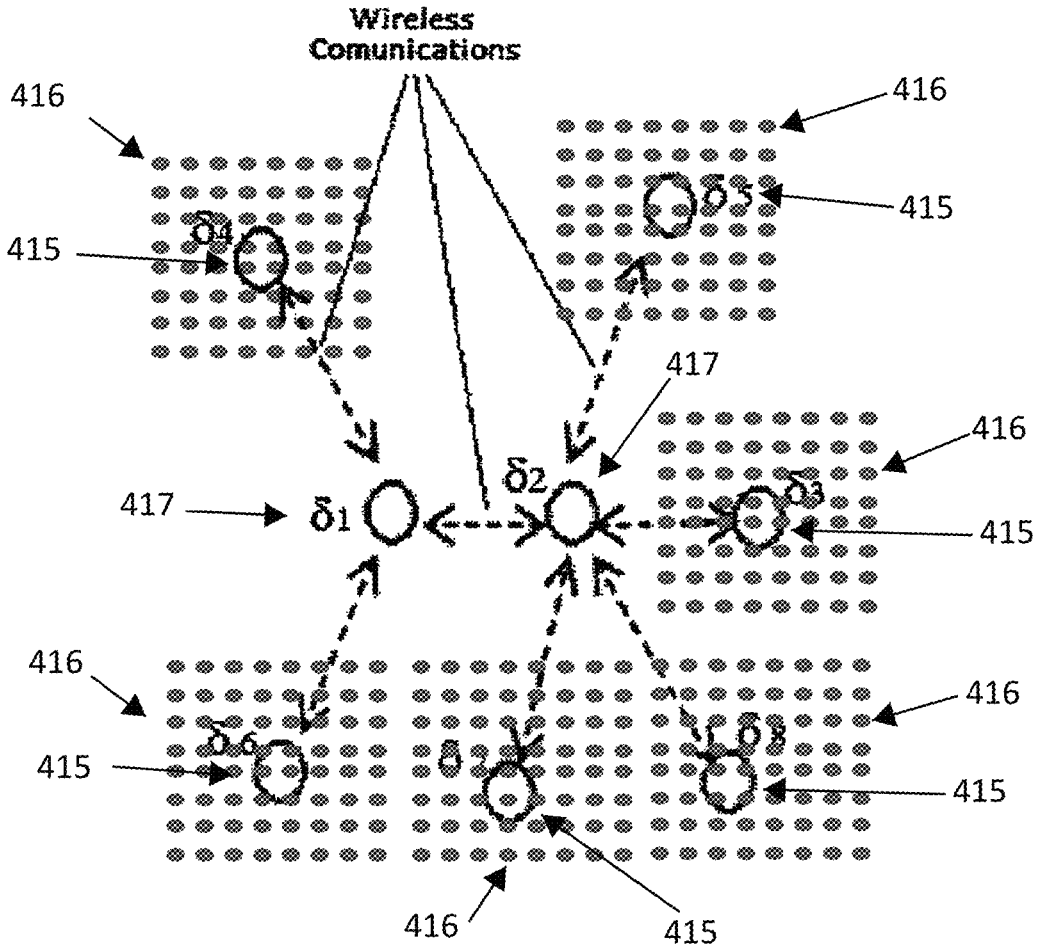
FIG. 4 is a top view of a set of blasting sensors according to various example aspects of the invention communicating with each other via cluster heads.
Figure 5:
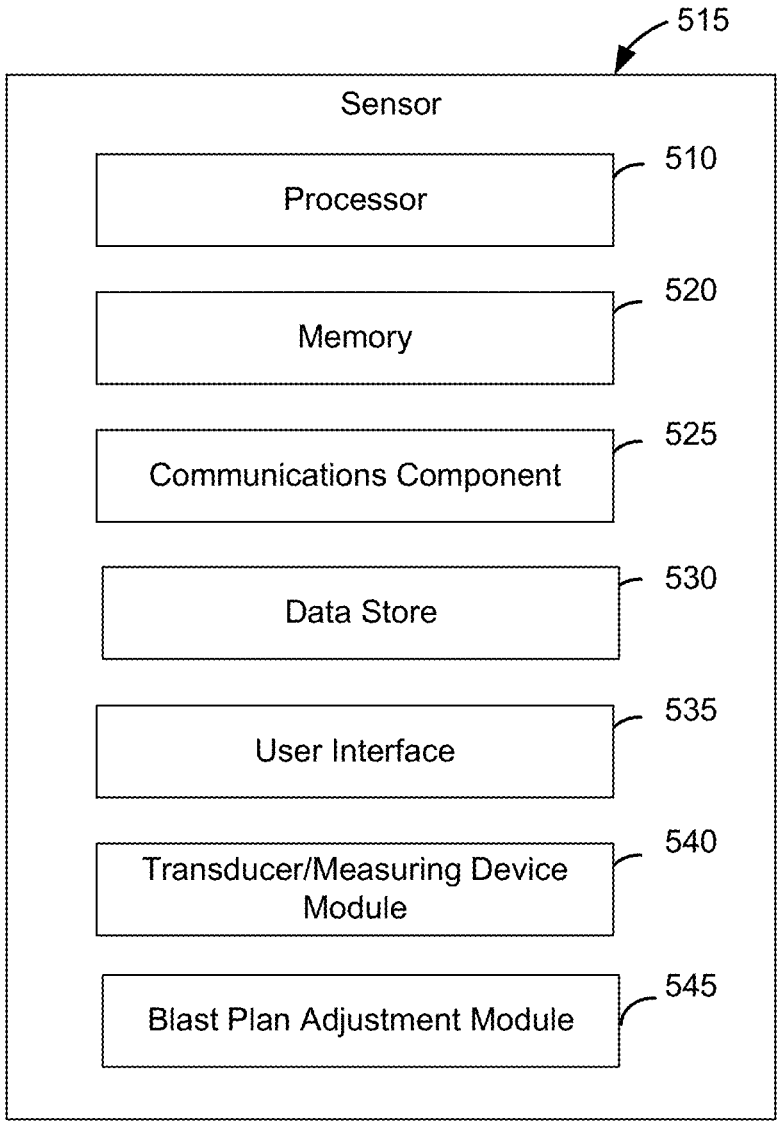
FIG. 5 is a computer device for use in the rock blasting system and method according to various example aspects of the invention.

After collecting and processing these data, each rock blasting sensor 215, 315, 415, 515, δi (e.g., "smart charge") may anticipate (e.g., change the detonation time to occur earlier), delay the time to detonation, or even cancel subsequent detonations, allowing a real-time adjustment/correction of the blast plan. In certain example aspects, each rock blasting sensor 215, 315, 415, 515, δi may include a processor 510 (e.g., "smart charge") and blast plan adjustment module 545 such that the system is fully distributed. In other example aspects, the system may be implemented in a hierarchical fashion where one or more blast loads (or explosive charges) 416 is associated with a cluster head including one or more rock blasting sensors 415, δi which sense and signal the triggering of the one or more charges 416 within a limited area (FIG. 4). Alternatively, for example, in the aspect of FIG. 4, some sensors, such as sensors δ1 and δ2, may act as relays to transfer information or signals between other sensors.

In certain aspects, a distinction of the present invention when compared to prior art wireless blasting methods is the ability to divert from a pre-selected/established firing pattern (e.g., to change or stop a rock blasting operation based on data received by one or more rock blasting sensors). In the most extreme scenario, a pre-established firing pattern does not exist. For the sake of the definitions henceforth, the "design of a pre-established firing pattern that does not exist" shall be considered the plan of detonation of a single explosive load (the first load to be exploded on a rock blasting operation) 215 after the explosion 220 of the first load, the system runs by itself, designing the chronological aspect of the blast plan in real time according to the set of data acquired by each rock blasting sensor after each explosion. In certain example aspects, the proposed invention turns the blast plan into a self-organizing system. That is, the real time application, based on the real-time data collected by each rock blasting sensor 215, 315, 415, 515, δi, allows for an automatic and quick change in the blast plan during the rock blasting operation. As a result, the method and system maximize the extraction of raw material while minimizing costs and environmental impact.

In example aspects, the system and method automatically adjust the blast plan such that the resulting blast plan differs, for example, temporally, from the original pre-established blast plan. The system and method accomplish this by collecting data and applying timing offsets for subsequent triggering of one or more blast loads 216, 416. Therefore, the system "self-adjusts" one or more detonation times for one or more blast loads 216, 416 based on real-time data.

Figure 2:
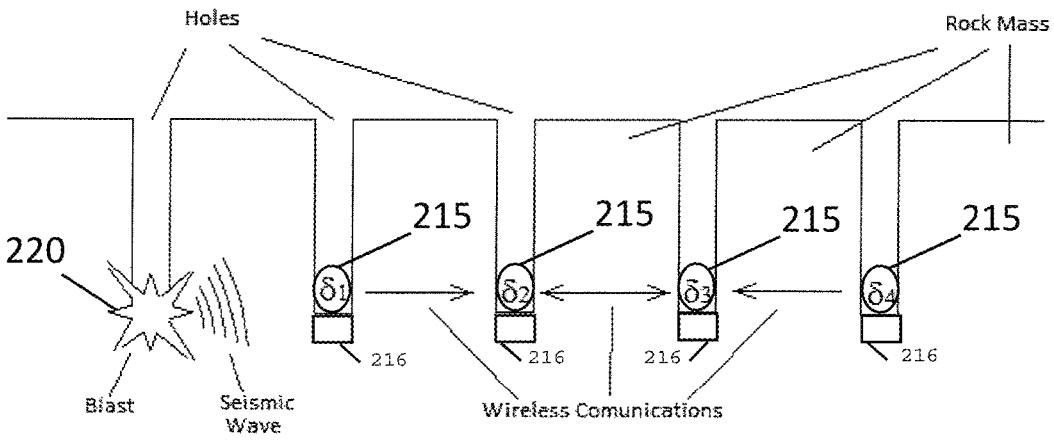
FIG. 2 is a cross sectional view of a rock mass showing a system of rock blasting smart loads according to various example aspects of the present invention.
Figure 3:
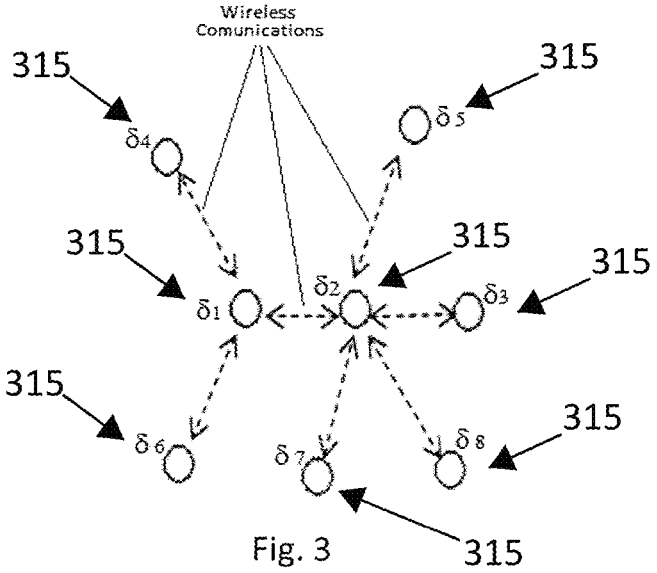
FIG. 3 is a top view of a set of blasting sensors according to various example aspects of the present invention communicating with each other through a net of wireless connections.

FIGS. 2 and 3 show the disposition of rock blast sensors 215, 315, δ1, δ2, δ3 . . . δi inside a rock mass according to various example aspects of the invention. The invention may employ a variable number of sensors arranged in a variety of geometrical distributions. As shown in FIGS. 2 and 3, each sensor 215, 315, δi may communicate with one or more nearby sensors, that in turn, communicate with other adjacent sensors, forming a wireless communication network.

FIG. 4 provides another arrangement of the rock blasting sensors and wireless network according to other example aspects of the invention. Instead of having one blasting sensor and one wireless communication device directly connected to each blast load 216, 416, cluster heads of rock blasting sensors 415, δi may be responsible for sensing and signaling the triggering of one or more charges 416 within a limited area (FIG. 4). Moreover, in some aspects, some of the sensors can also act as relay stations 417 not associated with any charges, e.g. $\delta_1$ and $\delta_2$.

Each rock blasting sensor 215, 315, 415, 515, δi may include a communications component 525, such as a transceiver, including, but not limited to, a transceiver belonging to the 802.11 family of standards (commonly known as WiFi), which are designed to allow the exchange of information between sensors. Such WiFi-enabled sensors are not connected by wires, therefore they do not stop communicating to each other due to wire disruption after a nearby explosion. It should be noted, however, that other types of transceivers may be utilized, such as a transceiver capable of communicating using other protocols such as, but not limited to, short range protocols such as Bluetooth or long range protocols such as cellular protocols (e.g., CDMA, GSM, LTE, etc.).

Each rock blasting sensor 215, 315, 415, 515, δi may also include a processor 510 and non-transitory computer readable storage medium such as a memory 520 (or data store 530) comprising computer-executable code or instructions for storing and reporting the relationship between the dispersion of the time and vibration levels measured after each explosion. In certain aspects, this information about the mining area may be useful for scientists and academic personnel in search of empirical data.

In yet further example aspects of the invention, the communications component 525 of each rock blasting sensor 215, 315, 415, 515, δi may include a radio component with an access control system, which is configured to control access to the transmission channel of the radio. This access control system is useful to avoid collisions and latencies that would prevent the exchange of information during the rock blasting operation.

When conventional wireless radio cannot be used, for instance, in underground sensors, the communications component 525 of the sensors may include transceivers that can communicate with each other by means of through the earth communications signaling (TTE).

As discussed above, each rock blasting sensor and charge arrangement may include or may be in communication with a particular processor 510 and non-transitory computer readable storage medium 520 comprising computer-executable code or instructions for performing the functions described herein, or an arrangement of a cluster head and one or more charges 415, 416 may be in communication with a processor 510 and non-transitory computer readable storage medium 515 comprising computer-executable code or instructions for performing the functions described herein. During operation, after initiation of the rock blasting operation, for example, by either detonating a pre-determined or randomly determined charge 220 or by initiating a pre-established firing pattern, the rock blasting sensors 215, 315, 415, 515, δi detect one or more parameters (as discussed above) and transmit this data to an associated processor 510. The processor 510 may transmit and receive data from other rock blasting sensors 215, 315, 415, 515, δi in the network and may include the computer-executable code or instructions in a module 545 for performing a blast plan adjustment algorithm to determine if and/or how to adjust the rock blasting operation (e.g., the firing pattern, the next blast location and/or the timing of the next blast).

In one example aspect, a blast plan adjustment algorithm implemented by the blast plan adjustment module 545 may be configured to generate an adjustment signal to make temporal adjustments to detonation trigger times for one or more charges based on comparing the received sensor information to thresholds that define expected ranges for the values of such information. For instance, one non-limiting example of such a blast plan adjustment algorithm is as follows:

```
EXCHANGE INFO
ELSEIF COLLECTION_OF_DATA >=
EXPECTED_RANGE_ OF_VALUES
THEN
TRIGGER "x" milliseconds sooner
EXCHANGE INFO
ELSEIF COLLECTION_OF_DATA <=
EXPECTED_RANGE_ OF_VALUES
    TRIGGER "x" milliseconds later
EXCHANGE INFO
ELSEIF (COLLECTION_OF_DATA >>
EXPECTED_RANGE_OF_VALUES) OR
(COLLECTION_OF_DATA <<
EXPECTED_RANGE_OF_VALUES)
    %ABNORMALITY IDENTIFIED
  CANCEL BLASTING;
  EXCHANGE INFO;
ELSE
    KEEP ORIGINAL TIMING
END
```

Such a blast plan adjustment algorithm may be executed by one or more sensors 215, 315, 415, 515, δi to, exchange information, generate the adjustment signal, and adjust the timing of one or more charges. In certain example aspects, COLLECTION_OF_DATA includes the information sensed locally by one or more smart charges (i.e., sensor and charge pair) and/or received via signaling from neighboring smart charges. For example, if a rock blasting sensor 215, 315, 415, 515, δi detects a shockwave propagation speed that is higher or lower than predicted in the pre-established firing pattern, the processor 510, for example, based on a determination from the blast plan adjustment module 540, will adjust the firing pattern accordingly, for example, by reducing or increasing the time until one or all subsequent blasts or by canceling the next blast altogether.

The degree of autonomy and flexibility of the rock blasting method of the present invention may be enhanced by the algorithms used by the blast plan adjustment module 545 executed by processor 510*t* and memory 520 embedded in (or in communication with) the sensors and the signaling capabilities, i.e. latency, bandwidth and medium access protocols, supported by the wireless communication interface of the communications component 525. While one example algorithm has been provided above, other algorithms for adjusting the blasting plan could be implemented in the systems and methods of the invention.

In certain aspects, the systems and methods of the invention may be used to minimize shock waves in a particular direction and/or to intensify shock waves in another direction by superposing different wave patterns. For example, techniques for superposing wave patterns can be used to adjust the timing of blasts to either minimize or intensify shock waves based on the data collected by the rock blasting sensors. For example, by adjusting the timing, the phase differences of the shock waves can be controlled. The phase differences dictate whether the waves will interfere (combined) constructively or destructively.

The wireless sensor network coupled to the explosive charges could also be employed to check for placement errors and offer complementary relative positional corrections in case the manual or automatic placement of the charges using e.g. global positioning system ("GPS") is slightly inaccurate. This can be achieved by well-established radio frequency based ("RE-based") positioning techniques such as received signal strength ("RSSI") measurements, time-of-flight or a combination thereof in order to improve the ranging accuracy.

The invention also provides a rock blasting method. In certain aspects, the method may include initiating a rock blasting operation via an initiation device, which may include or be in communication with a processor 510, based on a pre-established firing pattern. The pre-established firing pattern (or blasting plan) may be the detonation of a single charge 220.

The method may also include collecting real time data during the rock blasting operation via a plurality of sensors 215, 315, 415, 515, δi. The data may include parameters such as speed of propagation of the shock waves, pressure, tension, traction and temperature, before and after detonation of an explosive load which may collected by various transducers and measuring devices 540 of the sensors 215, 315, 415, 515, δi.

The method may also include adjusting in real time the rock blasting operation based on the collected real time data. The adjustment may include generating an adjustment signal based on an algorithm using a blast plan adjustment module and via a processor 510 making a temporal adjustment of the blasting plan including anticipating, delaying or canceling the rock blasting operation of at least one explosive load 215, 315, 415, 515, δi.

As discussed above, the systems and methods of the invention may include and be implemented by one or more computer devices integral with or in communication with the sensors/smart charges. Referring to FIGS. 2-4, in one aspect, any of devices 215, 315, 415, 515 may include a processor 510 for carrying out processing functions associated with one or more of the components and functions described herein. Processor 510 can include a single or multiple set of processors or multi-core processors. Moreover, processor 510 can be implemented as an integrated processing system and/or a distributed processing system.

Each sensor 515 may further include a memory 520, such as for storing data used herein and/or local versions of applications being executed by processor 510. Memory 520 can include any type of memory usable by a computer, such as random access memory (RAM), read only memory (ROM), tapes, magnetic discs, optical discs, volatile memory, non-volatile memory, and any combination thereof.

Further, each sensor 515 may include a communications component 525 that provides for establishing and maintaining communications with one or more entities utilizing hardware, software, and services as described herein. Communications component 525 may carry communications between components on the sensor 515, as well as between the sensor 515 and external devices, such as devices located across a communications network and/or devices serially or locally connected to the sensor 515. For example, communications component 525 may include one or more buses, and may further include transmit chain components and receive chain components associated with one or more transmitters and receivers, respectively, or one or more transceivers, operable for interfacing with external devices.

Optionally, sensor 515 may further include a data store 530, which can be any suitable combination of hardware and/or software, that provides for mass storage of information, databases, and programs employed in connection with aspects described herein. For example, data store 530 may be a data repository for applications not currently being executed by processor 510.

Optionally, sensor 515 may additionally include a user interface component 535 operable to receive inputs from a user of sensor 515, and further operable to generate outputs for presentation to the user. User interface component 535 may include one or more input devices, including but not limited to a keyboard, a number pad, a mouse, a touch-sensitive display, a navigation key, a function key, a microphone, a voice recognition component, any other mechanism capable of receiving an input from a user, or any combination thereof. Further, user interface component 535 may include one or more output devices, including but not limited to a display, a speaker, a haptic feedback mechanism, a printer, any other mechanism capable of presenting an output to a user, or any combination thereof.

The sensor 515 may also include a transducer/measuring device module 540 that collects data from various transducers and measuring devices associated with each sensor 215, 315, 415, 515, δi. In certain example aspects, the transducer/measuring device module 540 may be configured to analyze the data, for example, to calculate a change in parameters and to transmit such data to the blast plan adjustment module 545. The blast plan adjustment module 545 may be configured to perform an adjustment algorithm based on the received parameter data to determine timing adjustments to be made the rock blasting plan. In certain aspects, the blast plan adjustment module may transmit the adjustment data to the processor 510 to implement the change in the blasting plan.

As used in this application, the terms "component," "module," "system" and the like are intended to include a computer-related entity, such as but not limited to hardware, firmware, a combination of hardware and software, software, or software in execution. For example, a component may be, but is not limited to being, a process running on a processor, a processor, an object, an executable, a thread of execution, a program, and/or a computer. By way of illustration, both an application running on a computing device and the computing device can be a component. One or more components can reside within a process and/or thread of execution and a component may be localized on one computer and/or distributed between two or more computers. In addition, these components can execute from various computer readable media having various data structures stored thereon. The components may communicate by way of local and/or remote processes such as in accordance with a signal having one or more data packets, such as data from one component interacting with another component in a local system, distributed system, and/or across a network such as the Internet with other systems by way of the signal.

The various illustrative logics, logical blocks, modules, and circuits described in connection with the embodiments disclosed herein may be implemented or performed with a specially programmed processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Additionally, at least one processor may comprise one or more modules operable to perform one or more of the steps and/or actions described above.

Further, the steps and/or actions of a method or algorithm described in connection with the aspects disclosed herein may be embodied directly in hardware, in a software module executed by a processor, or in a combination of the two. A software module may reside in RAM memory, flash memory, ROM memory, EPROM memory, EEPROM memory, registers, a hard disk, a removable disk, a CD-ROM, or any other form of storage medium known in the art. An exemplary storage medium may be coupled to the processor, such that the processor can read information from, and write information to, the storage medium. In the alternative, the storage medium may be integral to the processor. Further, in some aspects, the processor and the storage medium may reside in an ASIC. Additionally, the ASIC may reside in a user terminal. In the alternative, the processor and the storage medium may reside as discrete components in a user terminal. Additionally, in some aspects, the steps and/or actions of a method or algorithm may reside as one or any combination or set of codes and/or instructions on a machine readable medium and/or computer readable medium, which may be incorporated into a computer program product.

In one or more aspects, the functions described may be implemented in hardware, software, firmware, or any combination thereof. If implemented in software, the functions may be stored as one or more instructions or code on a computer-readable medium. Computer-readable media includes any non-transitory computer storage media. A storage medium may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to store desired program code in the form of instructions or data structures and that can be accessed by a computer. Disk and disc, as used herein, includes compact disc (CD), laser disc, optical disc, digital versatile disc (DVD), floppy disk and blu-ray disc where disks usually reproduce data magnetically, while discs usually reproduce data optically with lasers. Combinations of the above should also be included within the scope of computer-readable media.

In summary, besides the maximization of the extraction of raw material and the minimization of production costs and environmental impact, in certain aspects the invention also brings further secondary advantages such as minor damage left on the rock mass and lower production of noise and vibrations (which avoids harmful exposition to nearby structures and buildings).

While aspects of this invention have been described in conjunction with the example features outlined above, alternatives, modifications, variations, improvements, and/or substantial equivalents, whether known or that are or may be presently unforeseen, may become apparent to those having ordinary skill in the art. Accordingly, the example aspects of the invention, as set forth above, are intended to be illustrative, not limiting. Various changes may be made without departing from the spirit thereof. Therefore, aspects of the invention are intended to embrace all known or later-developed alternatives, modifications, variations, improvements, and/or substantial equivalents.

The invention claimed is:

1. A rock blasting wireless sensor network, comprising:

an initiation system arranged to detonate a plurality of explosive loads in a rock blasting operation;

a plurality of rock blasting sensors arranged to detect rock blasting parameters during the rock blasting operation;

a wireless communication device arranged to communicate with the rock blasting sensors to exchange data;

a processor configured for decoding and processing the rock blasting parameters according to a blast plan adjustment algorithm to generate an adjustment signal; and wherein at least one of the rock blasting sensors is in communication with the processor, during the rock blasting operation, and is configured to receive the adjustment signal in real time, and to adjust a blast timing of at least one of the plurality of explosive loads.

2. The rock blasting wireless sensor network according to claim 1, wherein each of the rock blasting sensors can detect at least one of the following parameters: speed of propagation of shock waves, or pressure, or tension, or traction, or temperature.

3. The rock blasting wireless sensor network according to claim 1, wherein each rock blasting sensor is arranged to communicate with at least one other rock blasting sensor via through-the-earth communications signaling.

4. The rock blasting wireless sensor network according to claim 1, wherein the initiation system can initiate detonation of at least a first explosive load of the plurality of explosive loads, and wherein the blast plan adjustment algorithm can generate a self-organizing blast plan for the detonation of each successive explosive load based on a first set of data received from the plurality of rock blasting sensors after the detonation of the first explosive load and based on each successive set of data received from the plurality of rock blasting sensors after each successive detonation of each successive explosive load.

5. The rock blasting wireless sensor network according to claim 1, wherein the initiation system can initiate a pre-established blast plan, and wherein the blast plan adjustment algorithm can adjust the pre-established blast plan to form a self-organizing blast plan after each detonation based on each set of data received from the plurality of rock blasting sensors after each detonation.

6. The rock blasting wireless sensor network according to claim 1, wherein blast plan adjustment algorithm can generate successive self-organizing blast plans that each differ temporally from a pre-established blast plan.

7. The rock blasting wireless sensor network according to claim 1, wherein the blast plan adjustment algorithm can generate successive self-organizing blast plans that each differ from a pre-established blast plan, wherein the blast plan adjustment algorithm can adjust in real time the rock blasting operation based on the collected real time data, and wherein the blast plan adjustment algorithm can adjust by at least one of anticipating, delaying, or canceling a firing pattern of the rock blasting operation for at least one explosive load.

8. The rock blasting wireless sensor network according to claim 1, wherein the blast plan adjustment algorithm can adjust a firing pattern of the rock blasting operation in order to adjust a magnitude and/or direction of a shock wave by causing wave patterns to constructively or destructively interfere.

9. The rock blasting wireless sensor network according to claim 1, wherein the wireless communication device is configured to enable two or more of the plurality of rock blasting sensors to communicate with each other using at least through the earth (TTE) communication signaling.

10. The rock blasting wireless sensor network according to claim 1, wherein each rock blasting sensor of the plurality of rock blasting sensors includes a wireless communication device, and wherein adjacent rock blasting sensors of the plurality of the plurality of rock blasting sensors can communicate with one another via the wireless communication device.

11. The rock blasting wireless sensor network according to claim 10, wherein the adjacent rock blasting sensors communicate with each other using at least through the earth (TTE) communication signaling.

12. The rock blasting wireless sensor network according to claim 1, wherein the plurality of rock blasting sensors comprises a cluster of rock blasting sensors, and wherein the cluster is associated with one or more of the plurality of explosive loads.

13. The rock blasting wireless sensor network according to claim 12, wherein the cluster of rock blasting sensors communicate with each other using at least through the earth (TTE) communication signaling.

14. The rock blasting wireless sensor network according to claim 1, wherein one or more rock blasting sensors of the plurality of rock blasting sensors are configured to relay the data without being associated with an explosive load of the plurality of explosive loads.

15. The rock blasting wireless sensor network according to claim 14, wherein the plurality of rock blasting sensors configured to relay the data communicate with each other using at least through the earth (TTE) communication signaling.

16. The rock blasting wireless sensor network according to claim 1, wherein the processor is further configured to execute one or more positioning techniques to check for placement errors in a placement of the plurality of explosive loads and to generate complementary relative positional corrections to the placement of at least one of the plurality of explosive loads.

* * * * *